US007146750B2

(12) United States Patent
Issler

(10) Patent No.: US 7,146,750 B2
(45) Date of Patent: Dec. 12, 2006

(54) ONE-PIECE SHOE CONSTRUCTION WITH IMPROVED VENTILATION

(75) Inventor: David C. Issler, North Andover, MA (US)

(73) Assignee: Columbia Insurance Company, Omaha, NE (US)

( * ) Notice: Subject to any disclaimer, the term of this patent is extended or adjusted under 35 U.S.C. 154(b) by 10 days.

(21) Appl. No.: 10/820,110

(22) Filed: Apr. 7, 2004

(65) Prior Publication Data

US 2005/0223594 A1 Oct. 13, 2005

(51) Int. Cl.
*A43B 7/08* (2006.01)

(52) U.S. Cl. ..... 36/3 B; 36/30 A

(58) Field of Classification Search ..... 36/3 B, 36/28, 29, 3 R, 3 A
See application file for complete search history.

(56) References Cited

U.S. PATENT DOCUMENTS

| | | | | | |
|---|---|---|---|---|---|
| 1,852,883 | A * | 4/1932 | Gustaveson | 36/3 R |
| 3,729,840 | A | 5/1973 | Famolare, Jr. | 36/2.5 J |
| 3,769,722 | A | 11/1973 | Rhee | 36/2 R |
| 3,834,046 | A * | 9/1974 | Fowler | 36/28 |
| 4,063,371 | A * | 12/1977 | Batra | 36/3 B |
| 4,132,016 | A | 1/1979 | Vaccari | 36/114 |
| 4,408,401 | A | 10/1983 | Seidel et al. | 36/3 B |
| 4,476,600 | A | 10/1984 | Seidel et al. | 12/142 V |
| 4,505,056 | A | 3/1985 | Beneteau | 36/117 |
| 4,505,660 | A | 3/1985 | Seidel et al. | 425/129 S |
| 4,635,384 | A * | 1/1987 | Huh et al. | 36/29 |
| 4,654,982 | A * | 4/1987 | Lee | 36/3 R |
| 4,742,625 | A | 5/1988 | Sydor et al. | 36/3 R |
| 4,888,887 | A * | 12/1989 | Solow | 36/3 R |
| 5,083,385 | A | 1/1992 | Halford | 36/101 |
| 5,369,895 | A | 12/1994 | Hammerschmidt | 36/3 A |
| 5,595,003 | A * | 1/1997 | Snow | 36/28 |
| 5,606,806 | A * | 3/1997 | O'Dwyer | 36/3 B |
| 6,553,690 | B1 * | 4/2003 | Di Girolamo | 36/3 R |

* cited by examiner

*Primary Examiner*—Ted Kavanaugh
(74) *Attorney, Agent, or Firm*—St. Onge Steward Johnston & Reens LLC

(57) ABSTRACT

The invention relates to a apparatus and method for providing a shoe with an upper and a sole having a top surface, where the upper is integrally formed with the sole and where the top surface has a plurality of notches. The invention further includes a footbed having a bottom surface and being removably placed on the top surface, the bottom surface having a plurality of channels. The plurality of channels are placed in communication with the plurality of notches for ventilating the shoe.

13 Claims, 4 Drawing Sheets

ONE-PIECE SHOE CONSTRUCTION WITH IMPROVED VENTILATION

FIELD OF THE INVENTION

The invention relates to a shoe having improved construction and ventilation.

BACKGROUND OF THE INVENTION

A variety of different shoe constructions are used by the footwear industry. For the most part, each shoe construction has characteristics that make it particularly well-suited for specific applications. For example, some shoe constructions are selected for their durability, others for their flexibility and comfort, while still others are selected for their aesthetic appeal.

In general, shoe construction typically involves a number of manufacturing operations or steps. Normally, a significant number of manufacturing operations generally results in a more expensive shoe. In a market where competitive price is often desired, there appears to be a need to make shoes in an efficient manner. Some shoe constructions may involve an upper being stitched to a forepart of an outsole by a hand stitch and the rearpart of the outsole may be attached to the upper by adhesive after a lasting operation. Lasting is typically where a last, an object which simulates a user's foot, is inserted into the upper and the upper is often then pulled taught around the last and secured to a tuck, which is removably attached to the bottom of the last. The tuck generally provides a structure that is adhered to the rearpart of the outsole, which in turn results in the upper being secured to the outsole in the rearpart of the shoe. Without a tuck, it may be difficult to secure the upper to the outsole.

A traditional insole is often wrapped with a wrapper around its peripheral edge to help prevent the edge of the insole from wear. The insole with the wrapper is then typically secured to the tuck or outsole. In a separate operation, a socklining may then be adhered directly to the top of the insole for providing a surface adapted to receive a user's foot because the insole's surface is often coarse.

In addition to or instead of the above mentioned construction, cementing components of a shoe, such as the upper to the outsole, often involves a number of manufacturing operations. Typically, there is a surface preparation step where the surfaces to be cemented, or glued, are clean of debris and readied, which may also include roughening. Further, there may be an application step where the cement is applied to the surfaces. This step may also involve measuring and evenly distributing the glue over the surface.

Further, there may be a pressing step where the surfaces are pressed together. Pressing is believed to reduce air that may be trapped between the surfaces and enhances adhesion. Pressing may also include aligning the surfaces so that the peripheries of the components are flush with one another.

Additionally, once the components are pressed together, cementing often requires a waiting period for the cement to cure, or dry. Generally, not only does cementing involve some or all of the above mentioned manufacturing operations, it also involves time, particularly the curing time.

It is believed that the number of steps and time involved, especially if user intervention is required, negatively affects cost and efficiency. The cementing process may be further complicated if the surfaces to be glued are uneven or difficult to reach.

U.S. Pat. No. 5,369,895 to Hammerschmidt and U.S. Pat. Nos. 4,476,600, 4,408,401 and 4,505,660 to Seidel appear to relate to a shoe having a one piece construction. The one piece construction may reduce manufacturing steps to secure the upper to the outsole.

U.S. Pat. No. 4,742,625 to Sydor appears to relate to a shoe having a one piece construction and channels in the sole for ventilating the shoe. Sydor also appears to include a removable insole without ventilation channels.

Moreover, ventilating a shoe may be preferred as historically constructed footwear often confine the foot and usually lacks sufficient breathability, which may cause the foot to perspire and may also promote the development of bacteria, fungi and the like as well as any accompanying unpleasant odors and skin problems.

Some later developed footwear may attempt to solve the lack of sufficient breathability by providing openings in the upper but such openings may also allow debris and water to enter the shoe. U.S. Pat. No. 6,564,475 to Collins, U.S. Pat. No. 5,086,576 to Lamson, U.S. Pat. No. 6,553,690 to Di Girolamo, and U.S. Pat. No. 5,992,052 to Morris appear to relate to footwear with vent holes in the upper, sole, or both. Although these references may have vent holes in either the upper or sole, breathability is possibly still inadequate since the shoe lacks a mechanism that causes atmospheric air to enter the shoe and hot air within the shoe to exit the shoe.

Complicated valve arrangements may have been provided by other constructions to open and close an opening to reduce the amount of debris or water entering the shoe. However, these types of footwear may generally be more expensive to purchase. U.S. Pat. No. 6,282,813 to Squadroni and U.S. Pat. No. 5,992,052 to Moretti appear to relate to footwear having valves for venting the shoe.

Other approaches may include a pump encased within the shoe, sometimes in communication with openings in the upper. Generally, the weight of the foot is used to compress the pump and force air out of apertures to ventilate the foot. However, problems may arise if the pump fails to reinflate, which often occurs because the foot is typically placed on top of the pump and prevents full inflation. Moreover, such mechanisms are typically prohibitively expensive to build into footwear and, given that most of these devices are built into the shoe, they are not easily repairable or replaceable. U.S. Pat. No. 4,835,883 to Tetrault and U.S. Pat. No. 4,776,110 to Shiang and U.S. Publication No. 2002/0011009 to Pan appear to relate to footwear having pumps.

What is desired, therefore, is a shoe constructed in a more efficient manner without sacrificing quality. What is also desired is a shoe having a reduced number of manufacturing steps. What is further desired is a shoe having improved ventilation. Yet another desire is a shoe that has a ventilation system that cools the user's foot and provides sufficient breathability. A still further desire is a shoe with a ventilation system that reduces the amount of debris or water that enters the shoe. Yet another desire is a shoe that has a ventilation system that is reliable and inexpensive.

SUMMARY OF THE INVENTION

It is therefore an object of the invention to provide a shoe constructed in a more efficient manner without sacrificing quality.

It is another object to provide a shoe constructed with less manufacturing steps.

It is a further object of the invention to provide a shoe with improved ventilation.

Yet another object is to provide a shoe with a ventilation system that is reliable and inexpensive.

These and other objects of the invention are provided by a shoe having an upper and a sole having a top surface, where the upper is integrally formed with the sole and where the top surface has a plurality of notches. The invention further includes a footbed having a bottom surface and being removably placed on the top surface, the bottom surface having a plurality of channels. The plurality of channels are placed in communication with the plurality of notches for ventilating the shoe.

In some aspects of the invention, the sole may further include a through hole in a side of the sole extending from an inner surface to an outer surface of the sole. In these aspects, the plurality of channels and plurality of notches are in communication with the through hole. In some of these aspects, a filter may be placed on the through hole for inhibiting debris from entering the shoe.

Optionally, the plurality of channels may be in direct contact with the plurality of notches. In further aspects of the invention, the plurality of channels mate with the plurality of notches to define an enclosed plurality of passages for air to travel into and out of the shoe.

In further aspects of the footbed, a hole extends from a foot surface to the bottom surface or a side surface of the footbed, where the hole is in communication with the plurality of channels.

In still further aspects of the shoe, the upper includes a through opening extending from an inner surface to an outer surface of said upper, where the plurality of channels and plurality of notches are in communication with the through opening. A second filter may be employed on the through opening for inhibiting debris from entering the shoe.

In another aspect of the shoe, the upper has a toe area and a heel area. The sole includes a top surface and is integrally formed with the upper. The upper further extends around a localized periphery of the top surface, in the heel and toe areas, and extends upwardly away from the top surface to secure the shoe to a user's toe. The shoe may also include the plurality of channels, plurality of notches, through hole, and through opening as described above.

A method of providing the shoe described above includes the steps of providing a sole integrally combined with an upper, providing a plurality of notches in a top surface of the sole, providing a through hole in a side of the sole, providing a footbed with a plurality of channels in a bottom surface or a side surface of the footbed, providing a through hole extending from a foot surface of the footbed to the bottom surface or the side surface, and orientating the plurality of notches, plurality of channels, and through hole to be in communication with each other.

The method may further include the step of extending the upper upwardly around a localized periphery of the sole to secure the sole to a user's foot.

The invention and its particular features and advantages will become more apparent from the following detailed description considered with reference to the accompanying drawings.

DETAILED DESCRIPTION OF THE DRAWINGS

Figure 1:
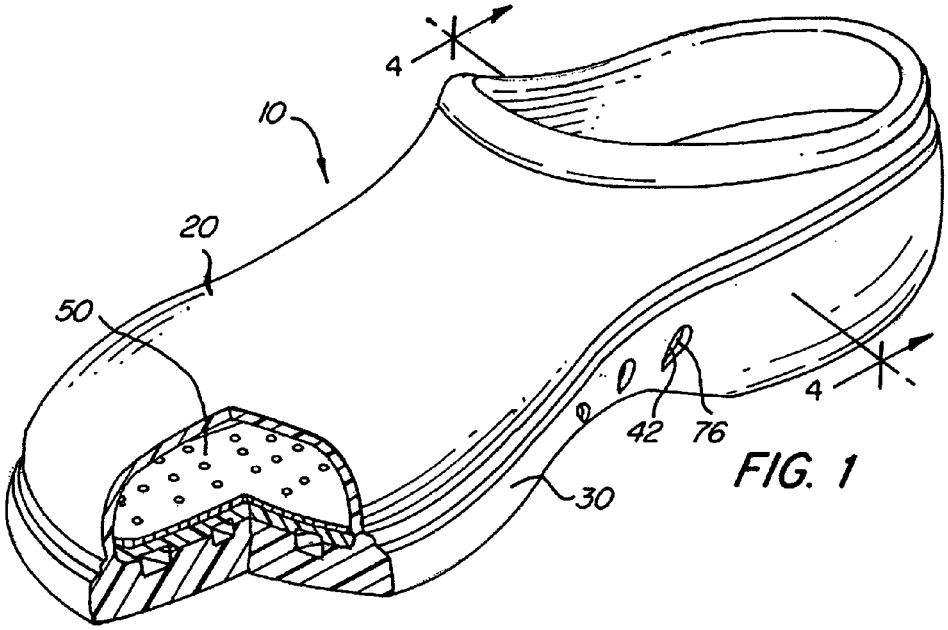
FIG. 1 depicts the shoe in accordance with the invention.
Figure 2:
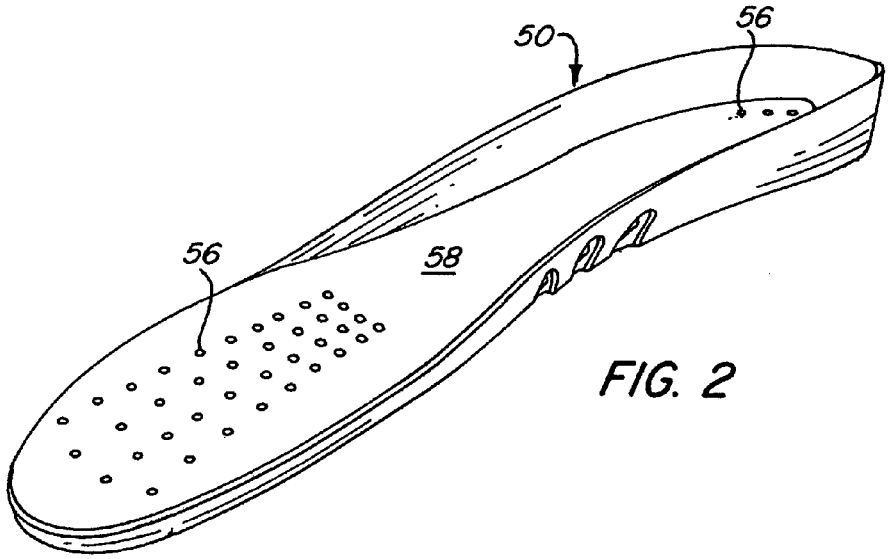
FIG. 2 more particularly depicts the footbed of FIG. 1.
Figure 4:
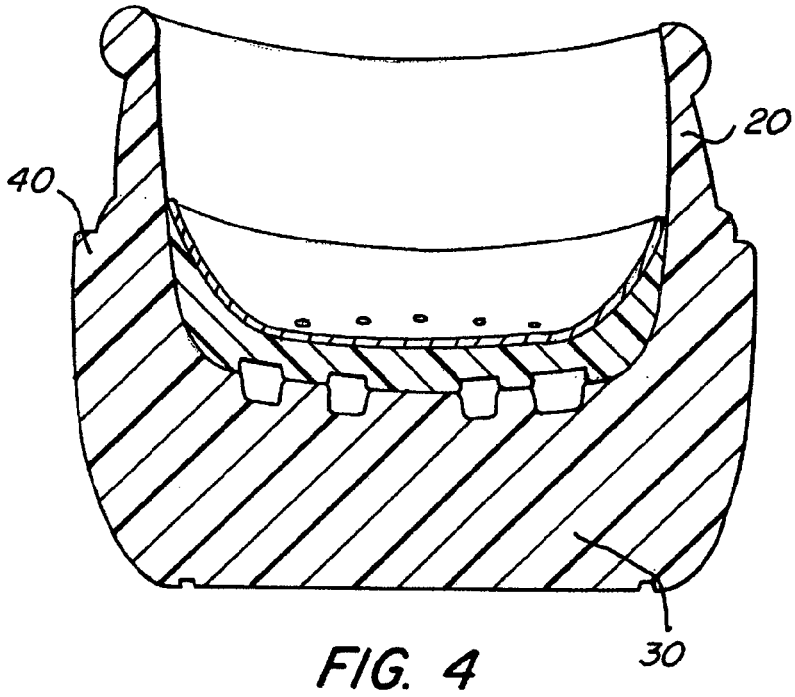
FIG. 4 depicts a cross sectional view of the shoe of FIG. 1.

FIG. 1 depicts shoe 10 in accordance with the invention. Shoe 10 includes upper 20 and outsole 30. As shown in FIG. 4, upper is integrally formed with outsole 30 to form a single unit, collectively referred to as one piece unit 40. Shoe 10 also includes footbed 50, which is removably placed within unit 40.

As shown in all figures, outsole 30 includes top surface 32 which in turn includes plurality 34 of channels. Plurality 34 of channels is in communication with plurality 54 of notches, which are provided in bottom surface 52 and side surface 59 of footbed 50, to ventilate the inside of unit 40 and cool a user's foot. As more particularly shown in FIGS. 3 and 4, plurality 34 of channels and plurality 54 of notches mate together to define, with respect to a cross sectional view of plurality 34 of channels and plurality 54 of notches, an enclosed plurality of passages. Such a mating relationship between footbed 50 and top surface 32 of outsole 30 enhances the size of the passages for air to exit and enter shoe 10, thereby improving ventilation, without increasing the thickness of either footbed 50 or outsole 30 to accommodate the entire plurality of passages as each accommodates a portion of the plurality of passages. Further, the structural integrity of both footbed 50 and outsole 30 are improved since less material is removed by each having to accommodate only a portion of the plurality of passages.

It is understood that plurality 34 of channels and plurality 54 of notches may have any orientation, such as being in wavy or straight lines along a length or width of shoe 10, so long as the orientation of plurality 34 of channels is consistent with plurality 54 of notches so that plurality 34 of channels and plurality 54 of notches are in mating communication with each other.

Additionally, although plurality 34 of channels and plurality 54 of notches are shown to be in mating communication with each other, where the plurality 34, 54 of channels and notches have the same orientation as one another, it is not required for shoe 10 to function properly. All that is required is that the channels in top surface 32 and notches in footbed 50 be in communication with each other. Moreover, a mating relationship between channels and notches need not require that each channel of plurality 34 of channels and each notches of plurality 54 of notches be in mating communication, as there may be some channels, such as channels on side surface 59, that may not be able to be mated with notches in top surface 32.

Unit 40 also includes through hole 42 in a side of outsole 30 where through hole 42 extends all the way through outsole 30 from inner surface 22 to outer surface 24. Through hole 42 is in communication with both plurality 34 of channels and plurality 54 of notches to ventilate air from inside shoe 10 to the atmosphere and draw fresh air from the atmosphere into shoe 10. Due to the flexible materials used to provide footbed 50 and outsole 30, air within unit 40 is forced out through hole 42 as a user compresses footbed 50 and outsole 30, and also plurality 34 of channels and plurality 54 of notches, during walking. At the end of a user's walking stride, footbed 50 and outsole 30 are decompressed, along with plurality 34 of channels and plurality 54 of notches, and air is therefore drawn in from the atmosphere via through hole 42 into shoe 10. As shown, multiple through holes 42 may be utilized. In some embodiments, through hole 42 includes filter 76 for inhibiting debris form entering shoe 10.

Figure 3:
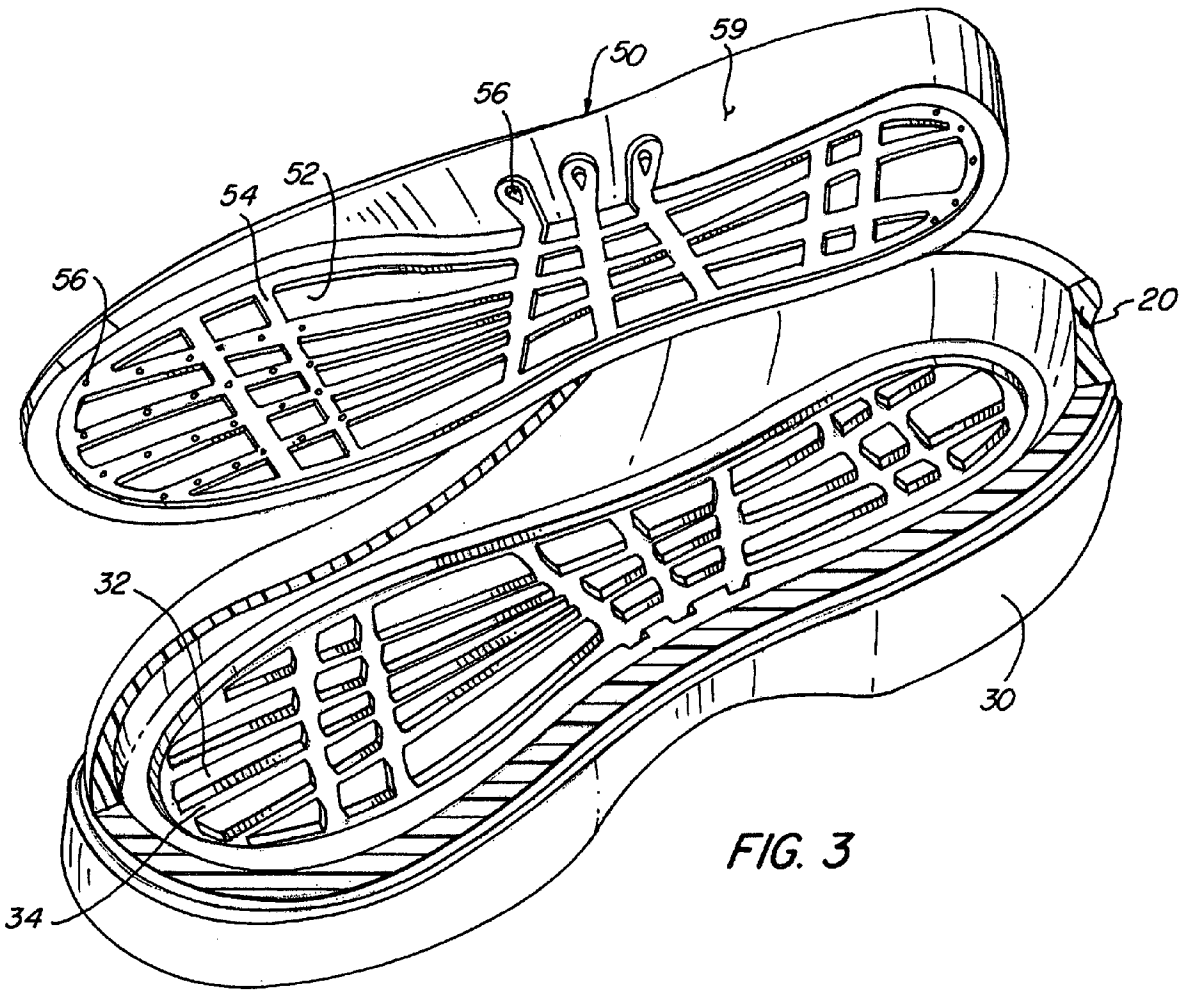
FIG. 3 more particularly depicts the footbed and outsole of FIG. 1.

FIG. 3 shows hole 56 in footbed 50 leading from foot surface 58 to either side surface 59 or bottom surface 52 of footbed 50. Hole 56 is in communication with plurality 34 of channels to provide an avenue for hot air to travel from above foot surface 58 to plurality 34 of channels, where the air would then travel out through hole 42. Fresh air is then brought to foot surface 58 in the reverse order.

Also as shown in FIG. 3, multiple holes 56 are used throughout footbed 50, including the toe and heel areas. It is understood that the location of hole 56 may be in any location provided it is from foot surface 58 to side surface 59 or bottom surface 52 and in communication with plurality 34 of channels to ventilate air from above foot surface 52 to plurality 34 of channels.

Figure 5:
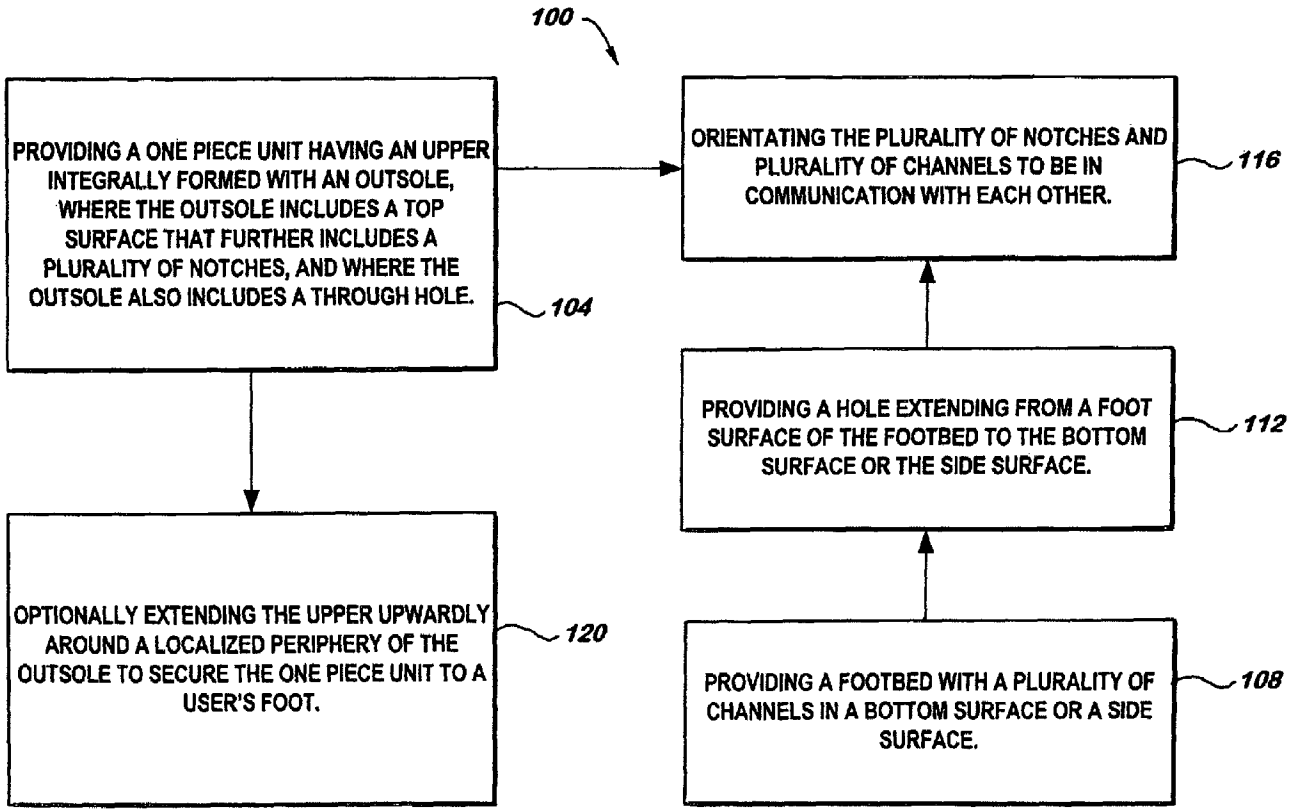
FIG. 5 depicts a method for providing the shoe of FIG. 1.

FIG. 5 depicts method 100 for providing shoe 10. Method 100 includes providing 104 a one piece unit, which includes the upper being integrally formed with the outsole. Providing 104 the one piece unit also includes providing a plurality of notches in a top surface of the outsole and a through hole in the outsole. The through hole is in communication with the plurality of notches so that air in the plurality of notches has a path for exiting the unit via through hole. Similarly, air from outside of the one piece unit may enter via through hole and into the plurality of notches.

Method 100 also includes providing 108 a footbed with a plurality of channels in a bottom surface or a side surface of the footbed. The footbed is formed separate from the one piece unit and is removably placed on the top surface of the outsole.

The invention further includes the step of providing 112 a hole in the footbed that extends from a foot surface of the footbed to the bottom surface or the side surface. The hole is in communication with the plurality of channels so that air above the foot surface has a path for entering the plurality of channels and, vice versa, air from the plurality of channels may travel through the hole to the foot surface.

Method 100 also includes orientating 116 the plurality of notches and plurality of channels so that the plurality of notches and channels are in communication with each other. By such a relationship between the plurality of notches and channels, a passage is defined for air to exit the shoe from above the foot surface to the plurality of channels and notches to through hole. Atmospheric air may also enter the shoe in the reverse direction. Moreover, in some areas of the shoe, the plurality of notches and plurality of channels define an enclosed passage (see cross sectional view shown in FIG. 4) which permit a larger volume of air to pass along the plurality of channels and notches and which may improve ventilation.

Optionally, method 100 may include the step of extending 120 the upper upwardly around a localized periphery of the outsole to secure the one piece unit to a user's foot. Extending 120 the upper in the heel area and toe area, which enlarges the surface area of the upper against the user's foot, enables the upper to more securely attach the unit to the foot.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A shoe, comprising:

an upper;

an outsole having a top surface;

said upper being combined with said outsole to provide a single unit;

a footbed having a bottom surface and being removably placed on said top surface;

said bottom surface having a plurality of channels extending across said bottom surface;

said top surface having a plurality of notches extending across said top surface;

said plurality of channels have an orientation similar at least in part to an orientation of said plurality of notches;

said plurality of channels being in communication with said plurality of notches for ventilating the shoe; and wherein said plurality of channels and plurality of notches mate together to define a plurality of passages.

2. The shoe in accordance with claim 1, wherein said plurality of channels are in direct contact with said plurality of notches.

3. The shoe in accordance with claim 1, wherein said outsole sole includes a through hole in a side of said outsole, wherein said through hole extends from an inner surface of said outsole to an outer surface of said outsole.

4. The shoe in accordance with claim 3, wherein said plurality of channels and said plurality of notches are in communication with said through hole.

5. The shoe in accordance with claim 3, wherein said through hole includes a filter for inhibiting debris from entering the shoe.

6. The shoe in accordance with claim 1, wherein said plurality of channels mate with said plurality of notches, wherein said plurality of channels and plurality of notches define an enclosed plurality of passages.

7. The shoe in accordance with claim 1, wherein said footbed further includes a hole extending from a foot surface to an outer surface, said hole being in communication with said plurality of channels.

8. The shoe in accordance with claim 7, wherein said outer surface is said bottom surface of said footbed.

9. The shoe in accordance with claim 7, wherein said outer surface is a side surface of said footbed.

10. The shoe in accordance with claim 1, wherein said upper further includes a toe area and a heel area, wherein said toe area extending around a localized periphery of said top surface and extending upwardly away from said top surface to secure the shoe to a user's toe; and said heel area extending around a localized periphery of said top surface and extending upwardly away from said top surface to secure the shoe to a user's heel.

11. The shoe in accordance with claim 10, wherein said outsole further comprises a through hole in a side of said outsole, wherein said through hole extends from an inner surface of said outsole to an outer surface of said outsole and is in communication with said plurality of channels and plurality of notches.

12. A method of providing a shoe, comprising the steps of:

providing an outsole integrally combined with an upper to provide a single unit;

extending a plurality of notches across a top surface of the outsole;

providing a through hole in a side of the outsole;

providing a footbed with a plurality of channels in extending accross a bottom surface or a side surface of the footbed;

providing a through hole extending from a foot surface of the footbed to the bottom surface or the side surface; and orientating the plurality of notches, plurality of channels, and through hole to be in communication with each other; and orientating the plurality of channels to be similar at least in part to the plurality of notches.

13. The method according to claim 12, further comprising the step of extending the upper upwardly around a localized periphery of the sole to secure the outsole to a user's foot.

* * * * *